US007910052B2

(12) United States Patent
Matsumoto

(10) Patent No.: US 7,910,052 B2
(45) Date of Patent: Mar. 22, 2011

(54) NEAR β-TYPE TITANIUM ALLOY

(75) Inventor: Satoshi Matsumoto, Osaka (JP)

(73) Assignee: Sumitomo Metal Industries, Ltd., Osaka (JP)

( * ) Notice: Subject to any disclaimer, the term of this patent is extended or adjusted under 35 U.S.C. 154(b) by 0 days.

(21) Appl. No.: 11/665,498

(22) PCT Filed: Oct. 14, 2005

(86) PCT No.: PCT/JP2005/018980

§ 371 (c)(1),
(2), (4) Date: Apr. 16, 2007

(87) PCT Pub. No.: WO2006/041167

PCT Pub. Date: Apr. 20, 2006

(65) Prior Publication Data

US 2008/0011395 A1 Jan. 17, 2008

(30) Foreign Application Priority Data

Oct. 15, 2004 (JP) ..... 2004-301272

(51) Int. Cl.
*C22C 14/00* (2006.01)

(52) U.S. Cl. ..... 420/420; 420/421; 148/421; 148/670

(58) Field of Classification Search ..... 148/421, 148/669, 670, 671; 420/417–421
See application file for complete search history.

(56) References Cited

U.S. PATENT DOCUMENTS

| | | | | |
|---|---|---|---|---|
| 3,405,016 | A * | 10/1968 | Jaffee et al. | 148/669 |
| 4,067,734 | A | 1/1978 | Curtis et al. | |
| 5,304,263 | A * | 4/1994 | Champin et al. | 148/671 |
| 5,362,441 | A * | 11/1994 | Ogawa et al. | 420/420 |
| 2003/0057615 | A1 * | 3/2003 | Eckert | 266/236 |

FOREIGN PATENT DOCUMENTS

| | | | |
|---|---|---|---|
| JP | 63-065042 | * | 3/1986 |
| JP | 62-017145 | * | 1/1987 |
| JP | 3-17886 | | 3/1991 |
| JP | 3-166350 | | 7/1991 |
| JP | 3-243739 | | 10/1991 |
| JP | 3243739 | * | 10/1991 |
| JP | 3-274238 | | 12/1991 |
| JP | 5-59510 | | 3/1993 |
| JP | 2-255780 | | 10/1993 |
| JP | 6-108187 | | 4/1994 |
| JP | 8-19502 | | 2/1996 |
| JP | 8-23053 | | 3/1996 |
| JP | 2536673 | | 7/1996 |
| JP | 2606023 | | 2/1997 |
| JP | 2669004 | | 7/1997 |
| JP | 9-209100 | | 8/1997 |
| JP | 2001-288518 | | 10/2001 |
| JP | 3365190 | | 11/2002 |
| SU | 443090 | * | 9/1974 |
| SU | 1593259 | * | 2/1989 |
| TW | 279806 | | 5/1984 |
| WO | 03/091468 | | 11/2003 |

OTHER PUBLICATIONS

Full English translation of Glazunov, SU 443090, published Sep. 25, 1974, 3 pages total.*

* cited by examiner

*Primary Examiner* — George Wyszomierski
*Assistant Examiner* — Mark L Shevin
(74) *Attorney, Agent, or Firm* — Clark & Brody

(57) ABSTRACT

A near-beta titanium alloy having higher strength than 'Ti-17' is provided, while suppressing cost increase. Such a near-&bgr; titanium alloy consists of, in weight percent, 0.5-7% of V, 0.5-2.5% of Fe, 0.5-5% of Mo, 0.5-5% of Cr, 3-7% of Al, and the balance of Ti and impurities. When the weight % of V content is expressed as $X_V$, the weight % of Fe content is expressed as $X_{Fe}$, the weight % of Mo content is expressed as $X_{Mo}$, and the weight % of Cr content is expressed as $X_{Cr}$; the value of $X_V+2.95X_{Fe}+1.5\ X_{Mo}+1.65X_{Cr}$ is 9-17%.

8 Claims, No Drawings

NEAR β-TYPE TITANIUM ALLOY

FIELD OF THE INVENTION

The present invention relates to a near β-type titanium alloy and a method for hot working thereof.

BACKGROUND OF THE INVENTION

Titanium alloys are light in weight and high in strength, and of them, titanium alloys called as near β-type titanium alloys that have a different phase such as the α-phase dispersed in the β-phase are broadly used since they can be hot worked at a temperature lower than the β transformation point and exhibit a high strength.

Of them, Ti-5Al-2Sn-2Zr-4Mo-4Cr is known as having an excellent strength, called as "Ti-17" and is broadly used.

It is also known that β-type titanium alloys or near β-type titanium alloys can increase the strength by being subjected to a heat treatment such as an aging treatment after being shaped. Patent Reference 1 discloses that the tensile strength is improved by subjecting a β titanium alloy to an aging treatment, and discloses that a specimen having a tensile strength of 70 kgf/mm$^2$ (about 690 MPa) improves the tensile strength to 130 kgf/mm$^2$ (about 1270 MPa) by being subjected to an aging treatment, according to a No. 4 specimen in Table 1 of the Patent Reference 1.

Patent Reference 2 discloses that a titanium alloy containing "Ti-17" as a representative component can have an increased strength by setting down the working temperature and the heat treatment temperature.

Meanwhile, in recent years, titanium alloys are required to be increased in strength for further application in various fields or further weight reduction, and sometimes required to have a higher strength than the "Ti-17". However, the aging treatment is generally carried out by maintaining an object at a temperature of about 500° C. for several hours, and therefore when forming, for example a titanium alloy having a higher strength than the "Ti-17", it is inevitable to lower the productivity (increase the manufacturing cost) due to the aging treatment. In addition, a special equipment for the aging treatment is required, which results in increase in equipment costs.

That is, conventional near β-type titanium alloys have a problem of making it difficult to obtain near β-type titanium alloys having a higher strength than the "Ti-17" while suppressing the cost increase.

Patent Reference 1: Japanese Patent No. 2669004

Patent Reference 2: Japanese Unexamined Patent Application Publication No. 2001-288518

DISCLOSURE OF THE INVENTION

Problems to be Solved by the Invention

In consideration of the above problems, it is an object of the present invention to provide a near β-type titanium alloy that has a higher strength than the "Ti-17" while suppressing the cost increase.

Means to Solve the Problems

The present inventors made intensive studies in order to solve the above problems, found that a near β-type titanium alloy having a higher strength than the "Ti-17" can be obtained without the necessity to carry out an aging treatment by calculating the content of each of β-phase stabilizing elements of a titanium alloy, namely V, Fe, Mo and Cr on the basis of a given formula, having a numerical value determined by this calculation lying within a given range, and containing a given amount of Al, and hence achieved the present invention.

Specifically, according to the present invention, there is provided a near β-type titanium alloy that comprises, by mass %, V: 0.5 to 7%, Fe: 0.5 to 2.5%, Mo: 0.5 to 5%, and Cr: 0.5 to 5%, wherein the value of $X_V+2.95X_{Fe}+1.5X_{Mo}+1.65X_{Cr}$ is from 9 to 17%, wherein $X_V$ represents the mass % of the V, $X_{Fe}$ represents the mass % of the Fe, $X_{Mo}$ represents the mass % of the Mo and $X_{Cr}$ represents the mass % of the Cr, and further comprising, by mass %, Al: 3 to 7%, wherein Ti and impurities constitute the residue.

In the present invention, by the near β-type titanium alloy is meant a titanium alloy that has a different phase such as the α phase dispersed in the β phase. The dispersing of a different phase such as the α phase in the β phase can be confirmed by, for example, microstructure observation and X-ray diffraction.

ADVANTAGES OF THE INVENTION

According to the present invention, V, Fe, Mo and Cr are contained as β-phase stabilizing elements, and Al is contained as an α-phase stabilizing element, in addition to Ti, and furthermore they are blended in given amounts, so that a titanium alloy can have more excellent strength than the "Ti-17" without the necessity to carry out an aging treatment, due to the solid solution hardening action.

Thus, it is possible to lower the necessity of providing a special equipment or process for such as an aging treatment, and thus obtain a titanium alloy having more excellent strength than the "Ti-17" while suppressing the cost increase.

DETAILED DESCRIPTION OF THE PREFERRED EMBODIMENT

Now, the description will be made for the reason for determining the content of each element in a near β-type titanium alloy of this embodiment.

The near β-type titanium alloy of this embodiment contains, by mass %, V: 0.5 to 7%, Fe: 0.5 to 2.5%, Mo: 0.5 to 5%, Cr: 0.5 to 5% and Al: 3 to 7%, and Ti and impurities, in which Ti and the impurities constitute the residue.

The near β-type titanium alloy made of these elements is usually hot worked at a temperature lower than the β transformation point, and cooled to obtain excellent strength. Whereby, it is possible to obtain a titanium alloy having more excellent strength than the "Ti-17" without the necessity to carry out an aging treatment.

V is contained, by mass %, within a range from 0.5 to 7% because when the content of V is less than 0.5%, a β-phase stabilizing effect is not obtainable; and when the content of V exceeds 7%, the strength more excellent than the "Ti-17" is not obtainable.

Fe is contained, by mass %, within a range from 0.5 to 2.5% because when the content of Fe is less than 0.5%, an advantage of solid solution hardening action is not obtainable and hence more excellent strength than the "Ti-17" is not obtainable; and when the content of Fe exceeds 2.5%, segregation of Fe occurs in a near β-type titanium alloy and hence unevenness in characteristics occurs.

In order to suppress the unevenness in characteristics of a near β-type titanium alloy while further lowering the material costs, the content of Fe is preferably within a range from 1 to 2%.

Mo is contained, by mass %, within a range from 0.5 to 5% because when the content of Mo is less than 0.5%, an advantage of solid solution hardening action is not obtainable and hence more excellent strength than the "Ti-17" is not obtainable; and when the content of Mo exceeds 5%, the workability is deteriorated, thus making it difficult to be worked. Furthermore, Mo is an expensive material and therefore a problem of increasing costs is caused as the content thereof is increased.

Cr is contained, by mass %, within a range from 0.5 to 5% because when the content of Cr is less than 0.5%, an advantage of solid solution hardening action is not obtainable, and hence more excellent strength than the "Ti-17" is not obtainable; and when the content of Cr exceeds 5%, segregation of Cr occurs in a near β-type titanium alloy and hence unevenness in characteristics occurs.

In order to suppress the unevenness in characteristics of a near β-type titanium alloy while further lowering the material costs, and prevent increase in deformation resistance, the content of Cr is preferably within a range from 3 to 4%.

Al acts on the stabilization of the α-phase while V, Fe, Mo and Cr are elements for stabilizing the β-phase, and Al is contained, by mass %, within a range from 3 to 7% because when the content of Al is less than 3%, the solution hardening action cannot be accelerated, and hence more excellent strength than the "Ti-17" is not obtainable; and when the content of Al exceeds 7%, Ti3Al is precipitated and thus the workability is deteriorated.

The content of Al is preferably within a range from 4 to 6% in order to suppress the deterioration of the workability while accelerating the solution hardening action.

The contents of V, Fe, Mo and Cr are set so that the value represented by $X_V+2.95X_{Fe}+1.5X_{Mo}+1.65X_{Cr}$ is from 9 to 17%, in which $X_V$ represents the mass % of the V, $X_{Fe}$ represents the mass % of the Fe, $X_{Mo}$ represents the mass % of the Mo and $X_{Cr}$ represents the mass % of the Cr. Whereby, it is possible to obtain more excellent strength than the "Ti-17". When the value is less than 9%, more excellent strength than the "Ti-17" is not obtainable, and when the value exceeds 17%, the workability is deteriorated.

The hot working temperature of the near β-type titanium alloy is preferably lower than the β transformation point and equal to or higher than a temperature 100° C. lower than the β transformation point, in order to have a good ductility by having microstructures formed into an equiaxial structure; have a good workability and thus decreasing the heat numbers; and prevent growth of scales.

It is possible to use Nb, Ta, Ni, Mn and Co solely or in combination with each other as β-phase stabilizing elements other than V, Fe, Mo and Cr. In this case, a titanium alloy contains Nb: 0.5 to 2%, Ta: 0.5 to 2%, Ni: 0.25 to 1%, Mn: 0.25 to 1% and Co: 0.25 to 1%, and the value of $X_V+2.95X_{Fe}+1.5X_{Mo}+1.65X_{Cr}+0.4X_{Nb}+0.3X_{Ta}+1.6X_{Ni}+2.3X_{Mn}+2.1X_{Co}$ is from 9 to 17%, in which $X_V$ represents the mass % of the V, $X_{Fe}$ represents the mass % of the Fe, $X_{Mo}$ represents the mass % of the Mo, $X_{Cr}$ represents the mass % of the Cr, $X_{Nb}$ represents the mass % of the Nb, $X_{Ta}$ represents the mass % of the Ta, $X_{Ni}$ represents the mass % of the Ni, $X_{Mn}$ represents the mass % of the Mn and $X_{Co}$ represents the mass % of the Co, so that the near β-type titanium alloy can have more excellent strength than the "Ti-17" while having excellent cold workability.

It is possible to use neutral atoms Sn, Zr as optional components solely or in combination by substituting a part of Al therewith according to needs and circumstances. In this case, a near β-type titanium alloy contains Sn: not more than 4%, Zr: not more than 4%, and the value of $X_{Al}+(X_{Sn}/3)+(X_{Zr}/6)$ is from 3 to 7, in which $X_{Al}$ represents the mass % of the Al, $X_{Sn}$ represents the mass % of the Sn and $X_{Zr}$ represents the mass % of the Zr, so that the near β-type titanium alloy has more excellent strength than the "Ti-17".

As impurities, inevitable impurities such as O and H exist, and in order to have a good ductility, the content of O is preferably not more than 0.25% by mass, and in order to efficiently improve the strength by an aging treatment, the content of H is preferably not more than 0.05% by mass.

EXAMPLES

Now, the description will be made in more detail for the present invention by citing Examples, without intention to limit the present invention to them.

Examples 1 to 16

Comparative Examples 1 to 12

Each ingot having a thickness of 20 mm, a width of 75 mm and a length of 97 mm was prepared by button arc melting to have the respective elements contained in each ratio as shown in Table 1, then hot rolled to have a 4 mm thickness plate at a temperature about 50° C. lower than the β transformation point.

The β transformation point was determined by reading out from a state diagram each variation of the β transformation point when each element was solely contained in a pure titanium, then calculating the summation of the variations, and adding the summation of the variations to the β transformation point of the pure titanium.

Then, they were processed into ASTM subsize tensile test pieces, which were each subjected to a tensile test at a rate of 0.1 mm/min according to JIS Z 2241 and the tensile strength and the 0.2% proof strength of each of them were determined.

As references, those having a 0.2% proof strength of 1300 MPa or higher were subjected to an aging treatment at 500° C. for 1 hour after hot rolling, and the tensile strength and the 0.2% proof strength of each of them were measured.

Comparative Examples 1, 2, 4, 7, 9, 10 and 11 had a low workability and therefore hot rolling could not carried out. Therefore, the tensile test was not carried out.

As Comparative Example 12, the tensile strength and the 0.2% proof strength, of the "Ti-17" were determined in the same manner. The evaluation results are shown in Table 2.

TABLE 1

| | COMPONENTS (%) | | | | | | | | | | | | | α-PHASE STABILIZATION | β-PHASE STABILIZATION |
|---|---|---|---|---|---|---|---|---|---|---|---|---|---|---|---|
| | V | Fe | Cr | Mo | Nb | Ta | Ni | Mn | Co | Al | Sn | Zr | Ti | INDICES *1 | INDICES *2 |
| EX. 1 | 1 | 1 | 4 | 2 | 0 | 0 | 0 | 0 | 0 | 5 | 3 | 0 | Residue | 6 | 13.55 |
| EX. 2 | 4 | 1 | 4 | 2 | 0 | 0 | 0 | 0 | 0 | 5 | 3 | 0 | Residue | 6 | 16.55 |
| EX. 3 | 1 | 1 | 4 | 1 | 0 | 0 | 0 | 0 | 0 | 5 | 3 | 0 | Residue | 6 | 12.05 |

TABLE 1-continued

| | COMPONENTS (%) | | | | | | | | | | | | | α-PHASE STABILIZATION | β-PHASE STABILIZATION |
|---|---|---|---|---|---|---|---|---|---|---|---|---|---|---|---|
| | V | Fe | Cr | Mo | Nb | Ta | Ni | Mn | Co | Al | Sn | Zr | Ti | INDICES *1 | INDICES *2 |
| EX. 4 | 1 | 1 | 4 | 4 | 0 | 0 | 0 | 0 | 0 | 5 | 3 | 0 | Residue | 6 | 16.55 |
| EX. 5 | 1 | 1 | 4 | 1 | 1 | 0 | 0 | 0 | 0 | 5 | 3 | 0 | Residue | 6 | 12.45 |
| EX. 6 | 1 | 1 | 4 | 1 | 0 | 1 | 0 | 0 | 0 | 5 | 3 | 0 | Residue | 6 | 12.35 |
| EX. 7 | 1 | 1 | 4 | 1 | 0 | 0 | 1 | 0 | 0 | 5 | 3 | 0 | Residue | 6 | 13.65 |
| EX. 8 | 1 | 1 | 4 | 1 | 0 | 0 | 0 | 1 | 0 | 5 | 3 | 0 | Residue | 6 | 14.35 |
| EX. 9 | 1 | 1 | 4 | 1 | 0 | 0 | 0 | 0 | 1 | 5 | 3 | 0 | Residue | 6 | 14.15 |
| EX. 10 | 1 | 1 | 4 | 2 | 0 | 0 | 0 | 0 | 0 | 4 | 3 | 0 | Residue | 5 | 13.55 |
| EX. 11 | 1 | 1 | 4 | 2 | 0 | 0 | 0 | 0 | 0 | 7 | 0 | 0 | Residue | 7 | 13.55 |
| EX. 12 | 1 | 1 | 4 | 2 | 0 | 0 | 0 | 0 | 0 | 5 | 0 | 3 | Residue | 5.5 | 13.55 |
| EX. 13 | 1 | 1 | 4 | 2 | 0 | 0 | 0 | 0 | 0 | 5 | 0 | 0 | Residue | 5 | 13.55 |
| EX. 14 | 3 | 1 | 4 | 2 | 0 | 0 | 0 | 0 | 0 | 5 | 3 | 0 | Residue | 6 | 15.55 |
| EX. 15 | 6 | 1 | 4 | 1 | 0 | 0 | 0 | 0 | 0 | 5 | 3 | 0 | Residue | 6 | 16.9 |
| EX. 16 | 1 | 1.5 | 1.5 | 1 | 0 | 0 | 0 | 0 | 0 | 5 | 2 | 2 | Residue | 6 | 9.4 |
| COMP. EX. 1 | 7 | 1 | 4 | 2 | 0 | 0 | 0 | 0 | 0 | 5 | 3 | 0 | Residue | 6 | 19.55 |
| COMP. EX. 2 | 8 | 1 | 4 | 2 | 0 | 0 | 0 | 0 | 0 | 5 | 3 | 0 | Residue | 6 | 20.55 |
| COMP. EX. 3 | 1 | 0 | 4 | 2 | 0 | 0 | 0 | 0 | 0 | 5 | 3 | 0 | Residue | 6 | 10.6 |
| COMP. EX. 4 | 1 | 3 | 4 | 2 | 0 | 0 | 0 | 0 | 0 | 5 | 3 | 0 | Residue | 6 | 19.45 |
| COMP. EX. 5 | 1 | 1 | 0 | 2 | 0 | 0 | 0 | 0 | 0 | 5 | 3 | 0 | Residue | 6 | 6.95 |
| COMP. EX. 6 | 1 | 1 | 1 | 2 | 0 | 0 | 0 | 0 | 0 | 5 | 3 | 0 | Residue | 6 | 8.6 |
| COMP. EX. 7 | 1 | 1 | 7 | 2 | 0 | 0 | 0 | 0 | 0 | 5 | 3 | 0 | Residue | 6 | 18.5 |
| COMP. EX. 8 | 1 | 1 | 4 | 0 | 0 | 0 | 0 | 0 | 0 | 5 | 3 | 0 | Residue | 6 | 10.55 |
| COMP. EX. 9 | 1 | 1 | 4 | 7 | 0 | 0 | 0 | 0 | 0 | 5 | 3 | 0 | Residue | 6 | 21.05 |
| COMP. EX. 10 | 1 | 1 | 4 | 1 | 0 | 0 | 0 | 0 | 0 | 2 | 2 | 0 | Residue | 2.67 | 12.05 |
| COMP. EX. 11 | 1 | 1 | 4 | 2 | 0 | 0 | 0 | 0 | 0 | 9 | 3 | 0 | Residue | 10 | 13.55 |
| COMP. EX. 12 | 0 | 0 | 4 | 4 | 0 | 0 | 0 | 0 | 0 | 5 | 2 | 2 | Residue | 6 | 12.6 |

*1: Values represented by $X_{Al} + (X_{Sn}/3) + (X_{Zr}/6)$

*2: Values represented by $X_V + 2.95X_{Fe} + 1.5X_{Mo} + 1.65X_{Cr} + 0.4X_{Nb} + 0.3X_{Ta} + 1.6X_{Ni} + 2.3X_{Mn} + 2.1X_{Co}$

TABLE 2

| | | Hot | After Hot Working | | | After Aging Treatment at 500° C. for 1 Hour | | |
|---|---|---|---|---|---|---|---|---|
| | β Trarans-Formation Point (° C.) | Rolling Temp. (° C.) | Proof Strength MPa | Tensile Strength MPa | Elongation % | Proof Strength MPa | Tensile Strength MPa | Elongation % |
| EX. 1 | 852 | 800 | 1333 | 1348 | 4.8 | 1502 | 1515 | 1.6 |
| EX. 2 | 808 | 750 | 1384 | 1415 | 1.2 | 1572 | 1585 | 0.4 |
| EX. 3 | 862 | 800 | 1301 | 1325 | 2.5 | 1475 | 1502 | 1.6 |
| EX. 4 | 831 | 800 | 1380 | 1397 | 1.6 | 1558 | 1572 | 0.6 |
| EX. 5 | 850 | 800 | 1327 | 1340 | 4 | 1495 | 1501 | 1.4 |
| EX. 6 | 850 | 800 | 1335 | 1352 | 3.5 | 1505 | 1525 | 0.8 |
| EX. 7 | 850 | 800 | 1340 | 1355 | 1.8 | 1511 | 1531 | 0.6 |
| EX. 8 | 850 | 800 | 1338 | 1350 | 2.5 | 1515 | 1530 | 0.5 |
| EX. 9 | 850 | 800 | 1335 | 1345 | 2 | 1505 | 1525 | 0.6 |
| EX. 10 | 831 | 800 | 1302 | 1335 | 3.2 | 1435 | 1475 | 2 |
| EX. 11 | 891 | 850 | 1335 | 1352 | 2 | 1495 | 1510 | 1.2 |
| EX. 12 | 853 | 800 | 1315 | 1326 | 2.4 | 1481 | 1502 | 1.5 |
| EX. 13 | 859 | 800 | 1303 | 1327 | 2.5 | 1441 | 1482 | 1.7 |
| EX. 14 | 822 | 750 | 1334 | 1349 | 3.6 | 1513 | 1543 | 0.4 |
| EX. 15 | 779 | 750 | 1375 | 1402 | 1.0 | 1565 | 1574 | 0.5 |
| EX. 16 | 921 | 850 | 1305 | 1322 | 1.0 | 1515 | 1510 | 0.6 |
| COMP. EX. 1 | 769 | 700 | — | — | — | — | — | — |
| COMP. EX. 2 | 758 | 700 | — | — | — | — | — | — |
| COMP. EX. 3 | 871 | 800 | 1209 | 1260 | 5.5 | — | — | — |

TABLE 2-continued

| | β Trarans-Formation Point (° C.) | Hot Rolling Temp. (° C.) | After Hot Working Proof Strength MPa | After Hot Working Tensile Strength MPa | After Hot Working Elongation % | After Aging Treatment at 500° C. for 1 Hour Proof Strength MPa | After Aging Treatment at 500° C. for 1 Hour Tensile Strength MPa | After Aging Treatment at 500° C. for 1 Hour Elongation % |
|---|---|---|---|---|---|---|---|---|
| COMP. EX. 4 | 814 | 750 | — | — | — | — | — | — |
| COMP. EX. 5 | 929 | 850 | 1056 | 1138 | 8 | — | — | — |
| COMP. EX. 6 | 909 | 850 | 1152 | 1202 | 7.1 | — | — | — |
| COMP. EX. 7 | 801 | 750 | — | — | — | — | — | — |
| COMP. EX. 8 | 873 | 800 | 1210 | 1255 | 5.1 | — | — | — |
| COMP. EX. 9 | 802 | 750 | — | — | — | — | — | — |
| COMP. EX. 10 | 788 | 750 | — | — | — | — | — | — |
| COMP. EX. 11 | 927 | 850 | — | — | — | — | — | — |
| COMP. EX. 12 | 890 | 850 | 1216 | 1252 | 4 | — | — | — |

It is seen that Examples 1 to 16 each have improved proof strength and tensile strength as compared with the result of Comparative Example 12 representative of the "Ti-17" near β-type titanium alloy, and have more excellent strength than the "Ti-17" near β-type titanium alloy.

The invention claimed is:

1. A near β-type titanium alloy consisting essentially of, by mass %, V: 0.5 to 1.0%, Fe: 0.5 to 2.5%, Mo: 0.5 to 2% and Cr: 3 to 5%, wherein the value of $X_V+2.95X_{Fe}+1.5X_{Mo}+1.65X_{Cr}$ is from 9 to 17%, wherein $X_V$ represents the mass % of the V, $X_{Fe}$ represents the mass % of the Fe, $X_{Mo}$ represents the mass % of the Mo and $X_{Cr}$ represents the mass % of the Cr, and further comprising, by mass %, Al: 3 to 7%, wherein Ti and impurities constitute the residue, wherein the near β-type titanium alloy has a microstructure formed into an equiaxial structure.

2. A near β-type titanium alloy consisting essentially of, by mass %, V: 0.5 to 1.0%, Fe: 0.5 to 2.5%, Mo: 0.5 to 2% and Cr: 3 to 5%, wherein the value of $X_V+2.95X_{Fe}+1.5X_{Mo}+1.65X_{Cr}$ is from 9 to 17%, wherein $X_V$ represents the mass % of the V, $X_{Fe}$ represents the mass % of the Fe, $X_{Mo}$ represents the mass % of the Mo, and $X_{Cr}$ represents the mass % of the Cr, and further comprising, by mass %, Al: 3% to less than 7% and at least one of the group consisting of Sn: not less than 3% and not more than 4% and Zr: not more than 4%, wherein the value of $X_{Al}+(X_{Sn}/3)+(X_{Zr}/6)$ is from 3 to 7, wherein $X_{Al}$ represents the mass % of the Al, $X_{Sn}$ represents the mass % of the Sn and $X_{Zr}$ represents the mass of the Zr, wherein Ti and impurities constitute the residue, wherein the near β-type titanium alloy has a microstructure formed into an equiaxial structure.

3. A near β-type titanium alloy comprising, by mass %, V: 0.5 to 1.0%, Fe: 0.5 to 2.5%, Mo: 0.5 to 2%, Cr: 3 to 5% and at least one selected from the group consisting of Nb: 0.5 to 2%, Ta: 0.5 to 2%, Ni: 0.25 to 1%, Mn: 0.25 to 1% and Co: 0.25 to 1%, wherein the value of $X_V+2.95X_{Fe}+1.5X_{Mo}+1.65X_{Cr}+0.4X_{Nb}+0.3X_{Ta}+1.6X_{Ni}+2.3X_{Mn}+2.1X_{Co}$ is from 9 to 17%, wherein $X_V$ represents the mass % of the V, $X_{Fe}$ represents the mass % of the Fe, $X_{Mo}$ represents the mass % of the Mo, $X_{Cr}$ represents the mass % of the Cr, $X_{Nb}$ represents the mass % of the Nb, $X_{Ta}$ represents the mass % of the Ta, $X_{Ni}$ represents the mass % of the Ni, $X_{Mn}$ represents the mass % of the Mn and $X_{Co}$ represents the mass % of the Co, and further comprising, by mass %, Al: 3 to 7%, wherein Ti and impurities constitute the residue, wherein the near β-type titanium alloy has a microstructure formed into an equiaxial structure.

4. A near β-type titanium alloy comprising, by mass %, V: 0.5 to 1.0%, Fe: 0.5 to 2.5%, Mo: 0.5 to 2%, Cr: 3 to 5% and at least one selected from the group consisting of Nb: 0.5 to 2%, Ta: 0.5 to 2%, Ni: 0.25 to 1%, Mn: 0.25 to 1% and Co: 0.25 to 1%, wherein the value of $X_V+2.95X_{Fe}+1.5X_{Mo}+1.65X_{Cr}+0.4X_{Nb}+0.3X_{Ta}+1.6X_{Ni}+2.3X_{Mn}+2.1X_{Co}$ is from 9 to 17%, wherein $X_V$ represents the mass % of the V, $X_{Fe}$ represents the mass % of the Fe, $X_{Mo}$ represents the mass % of the Mo, $X_{Cr}$ represents the mass % of the Cr, $X_{Nb}$ represents the mass % of the Nb, $X_{Ta}$ represents the mass % of the Ta, $X_{Ni}$ represents the mass % of the Ni, $X_{Mn}$ represents the mass % of the Mn and $X_{Co}$ represents the mass % of the Co, and further comprising, by mass %, Al: 3% to less than 7% and at least one selected from the group consisting of Sn: not less than 3% and not more than 4% and Zr: not more than 4%, wherein the value of $X_{Al}+(X_{Sn}/3)+(X_{Zr}/6)$ is from 3 to 7, wherein $X_{Al}$ represents the mass % of the Al, $X_{Sn}$ represents the mass % of the Sn and $X_{Zr}$ represents the mass % of the Zr, and wherein Ti and impurities constitute the residue, wherein the near β-type titanium alloy has a microstructure formed into an equiaxial structure.

5. A method for hot working of the near β-type titanium alloy of claim 1, comprising hot working a near β-type titanium alloy at a temperature lower than the β transformation point and equal to or higher than a temperature 100° C. lower than the β transformation point.

6. A method for hot working of the near β-type titanium alloy of claim 2, comprising hot working a near β-type titanium alloy at a temperature lower than the β transformation point and equal to or higher than a temperature 100° C. lower than the β transformation point.

7. A method for hot working of the near β-type titanium alloy of claim 3, comprising hot working a near β-type titanium alloy at a temperature lower than the β transformation point and equal to or higher than a temperature 100° C. lower than the β transformation point.

8. A method for hot working of the near β-type titanium alloy of claim 4, comprising hot working a near β-type titanium alloy at a temperature lower than the β transformation point and equal to or higher than a temperature 100° C. lower than the β transformation point.

* * * * *